US009651891B2

(12) United States Patent
Araki et al.

(10) Patent No.: US 9,651,891 B2
(45) Date of Patent: May 16, 2017

(54) IMAGE FORMING APPARATUS EMPLOYING TECHNIQUE THAT REDUCES AMOUNT OF COLORING MATERIAL CONSUMED

(71) Applicant: CANON KABUSHIKI KAISHA, Tokyo (JP)

(72) Inventors: Go Araki, Suntou-gun (JP); Norihito Naito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/205,597

(22) Filed: Jul. 8, 2016

(65) Prior Publication Data

US 2016/0320722 A1 Nov. 3, 2016

Related U.S. Application Data

(63) Continuation of application No. 15/015,540, filed on Feb. 4, 2016, now Pat. No. 9,417,579, which is a (Continued)

(30) Foreign Application Priority Data

Jan. 21, 2014 (JP) ..... 2014-008862

(51) Int. Cl.
*G03G 15/04* (2006.01)
*G03G 15/00* (2006.01)
*G03G 15/043* (2006.01)

(52) U.S. Cl.
CPC ..... *G03G 15/043* (2013.01); *G03G 15/50* (2013.01); *G03G 2215/0431* (2013.01)

(58) Field of Classification Search
CPC .... G03G 15/011; G03G 15/043; G03G 15/50; G03G 15/5033; G03G 15/55;
(Continued)

(56) References Cited

U.S. PATENT DOCUMENTS 6,039,435 A 3/2000 Wakahara
6,532,030 B2 3/2003 Okano et al.
(Continued)

FOREIGN PATENT DOCUMENTS

JP 2000-343748 A 12/2000
JP 2002-244370 A 8/2002
(Continued)

OTHER PUBLICATIONS

Search Report in UK Patent Application No. GB15006463, dated Jul. 15, 2015.
(Continued)

*Primary Examiner* — Sophia S Chen
(74) *Attorney, Agent, or Firm* — Fitzpatrick, Cella, Harper & Scinto

(57) ABSTRACT

When an edge effect or sweeping occurs in a developing material, pixels, among a plurality of pixels that configure image data, will arise in which a developing material consumption amount rises beyond an original consumption amount. A CPU corrects the developing material consumption amount for the pixels, among the plurality of pixels that configure the image data, in which the developing material consumption amount will rise beyond the original consumption amount.

18 Claims, 12 Drawing Sheets

Related U.S. Application Data continuation of application No. 14/596,398, filed on Jan. 14, 2015, now Pat. No. 9,298,124.

(58) Field of Classification Search

CPC ..... G03G 21/20; G03G 2215/0431; G03G 2215/0448; G03G 2215/0465

USPC ..... 399/51, 53, 187

See application file for complete search history.

(56) References Cited

U.S. PATENT DOCUMENTS

| | | | |
|---|---|---|---|
| 6,686,942 | B2 | 2/2004 | Okano et al. |
| 7,085,003 | B1 | 8/2006 | Belkhir |
| 8,422,070 | B2 | 4/2013 | Yamauchi |
| 2009/0110419 | A1 | 4/2009 | Suzuki et al. |
| 2009/0220264 | A1 | 9/2009 | Kobayashi et al. |
| 2010/0253694 | A1 | 10/2010 | Kambegawa |
| 2011/0058831 | A1 | 3/2011 | Usami et al. |
| 2012/0127488 | A1 | 5/2012 | Nakatsuji |
| 2013/0057924 | A1 | 3/2013 | Genda |
| 2013/0108290 | A1 | 5/2013 | Funatani et al. |
| 2015/0002903 | A1 | 1/2015 | Arai et al. |

FOREIGN PATENT DOCUMENTS

| | | | |
|---|---|---|---|
| JP | 2003-345076 | A | 12/2003 |
| JP | 2004-219929 | A | 8/2004 |
| JP | 2004-299239 | A | 10/2004 |
| JP | 2005-225090 | A | 8/2005 |
| JP | 2005-303882 | A | 10/2005 |
| JP | 2007-005972 | A | 1/2007 |
| JP | 2007-272153 | A | 10/2007 |
| JP | 2008-129110 | A | 6/2008 |
| JP | 2009-069680 | A | 4/2009 |
| JP | 2009-118378 | A | 5/2009 |

OTHER PUBLICATIONS

UK Combined Search and Examination Report dated Sep. 22, 2016, in UK Patent Application No. GB1604754.0.

FIG. 10A

| | CONDITION 1 | CONDITION 2 | CONDITION 3 | CONDITION 4 |
|---|---|---|---|---|
| CORRECTION RANGE PARAMETER | 6 PIXELS | 5 PIXELS | 4 PIXELS | 3 PIXELS |
| EXPOSURE AMOUNT ADJUSTMENT PARAMETER | 50% | 40% | 30% | 20% |

FIG. 10B

| | CONDITION 1 | CONDITION 2 | CONDITION 3 | CONDITION 4 |
|---|---|---|---|---|
| CORRECTION RANGE PARAMETER | 5 PIXELS | 5 PIXELS | 3 PIXELS | — |
| EXPOSURE AMOUNT ADJUSTMENT PARAMETER | 50% | 40% | 30% | — |

FIG. 10C

| | CONDITION 1 | CONDITION 2 | CONDITION 3 | CONDITION 4 |
|---|---|---|---|---|
| CORRECTION RANGE PARAMETER | 7 PIXELS | 7 PIXELS | 6 PIXELS | 6 PIXELS |
| EXPOSURE AMOUNT ADJUSTMENT PARAMETER | 60% | 60% | 40% | 30% |

| | | | | | | | | | |
|---|---|---|---|---|---|---|---|---|---|
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |
| 255 | 255 | 255 | 255 | 255 | 255 | 255 | 255 | 255 | 255 |

| | | | | | | | | | |
|---|---|---|---|---|---|---|---|---|---|
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 0 | 0 | 0 | 0 | 1 | 1 | 1 |
| 1 | 1 | 1 | 0 | 0 | 0 | 0 | 1 | 1 | 1 |
| 1 | 1 | 1 | 0 | 0 | 0 | 0 | 1 | 1 | 1 |
| 1 | 1 | 1 | 0 | 0 | 0 | 0 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |
| 1 | 1 | 1 | 1 | 1 | 1 | 1 | 1 | 1 | 1 |

IMAGE FORMING APPARATUS EMPLOYING TECHNIQUE THAT REDUCES AMOUNT OF COLORING MATERIAL CONSUMED

This application is a continuation of U.S. patent application Ser. No. 15/015,540, filed Feb. 4, 2016, which is a continuation of U.S. patent application Ser. No. 14/596,398, filed Jan. 14, 2015, and issued as U.S. Pat. No. 9,298,124, on Mar. 29, 2016, and which claims the benefit of Japanese Patent Application No. 2014-008862, filed Jan. 21, 2014, all of which are hereby incorporated by reference herein in their entireties.

BACKGROUND OF THE INVENTION

Field of the Invention

The present invention relates to image forming apparatuses, image processing apparatuses, image processing methods, and programs that employ techniques that reduce the amount of coloring materials consumed.

Description of the Related Art

In image forming apparatuses, it is desirable to reduce the amount of toner consumed by the apparatus. Japanese Patent Laid-Open No. 2004-299239 proposes a technique that cuts back on the amount of toner consumed by reducing an exposure intensity for an image region having a certain amount of surface area.

A phenomenon can occur in which developing material increases excessively at the edges of images formed by an image forming apparatus (called an "edge effect"), and a phenomenon can also occur in which developing material increases excessively at the following end areas of the image in a sub-scanning direction (called "sweeping"), and so on. The edge effect and sweeping arise with varying intensity as the environment conditions in which the image forming apparatus is used, the remaining lifespan of the image forming apparatus, and so on change. Despite such circumstances, the amount of developing material that is consumed can be further reduced if such excessive increases in developing material can be suppressed.

SUMMARY OF THE INVENTION

The present invention suppresses an increase in the amount of developing material consumed by correcting pixels, among a plurality of pixels that configure image data, in which the amount of developing material consumed increases beyond a desired amount.

The present invention provides an image forming apparatus comprising: an image carrier; an exposure unit configured to form an electrostatic latent image on the image carrier by irradiating the image carrier with light based on image data; a developing unit configured to develop the electrostatic latent image formed on the image carrier using a developing material; a specifying unit configured to specify a specific pixel, of the plurality of pixels that configure the image data, having a second developing material amount used in the development performed by the developing unit that is greater than a first developing material amount determined by the image data; and a correcting unit configured to correct an image forming condition so that the second developing material amount for the specific pixel at least approaches the first developing material amount for the specific pixel, wherein the correcting unit corrects the image forming condition for the specified pixel by dividing the specified pixel into a plurality of sub pixels and thinning out at least one of the plurality of sub pixels.

Further features of the present invention will become apparent from the following description of exemplary embodiments (with reference to the attached drawings).

BRIEF DESCRIPTION OF THE DRAWINGS

FIGS. 10A-10C are diagrams illustrating the association of conditions detected by a detection device with correction parameters.

DESCRIPTION OF THE EMBODIMENTS

The present embodiment corrects the pixel value of pixels, among a plurality of pixels that configure image data, in which the edge effect or sweeping can occur in the developing material. This reduces the edge effect or sweeping in the developing material. There is a correlation between the intensity of the edge effect, sweeping, or the like in the developing material and environment conditions where an image forming apparatus is installed (temperature, humidity, and so on), the remaining lifespan of components involved in developing (photosensitive members, developing materials, developing members, and so on). If such conditions are taken into consideration when determining a correction target pixel, the edge effect or sweeping in the developing material can be reduced with precision. Directly correcting the pixel values (tone values/density values) in the image data, indirectly correcting the pixel values by correcting exposure amounts, and so on can be given as examples of correction methods.

Overview of Image Forming Apparatus

Figure 1:
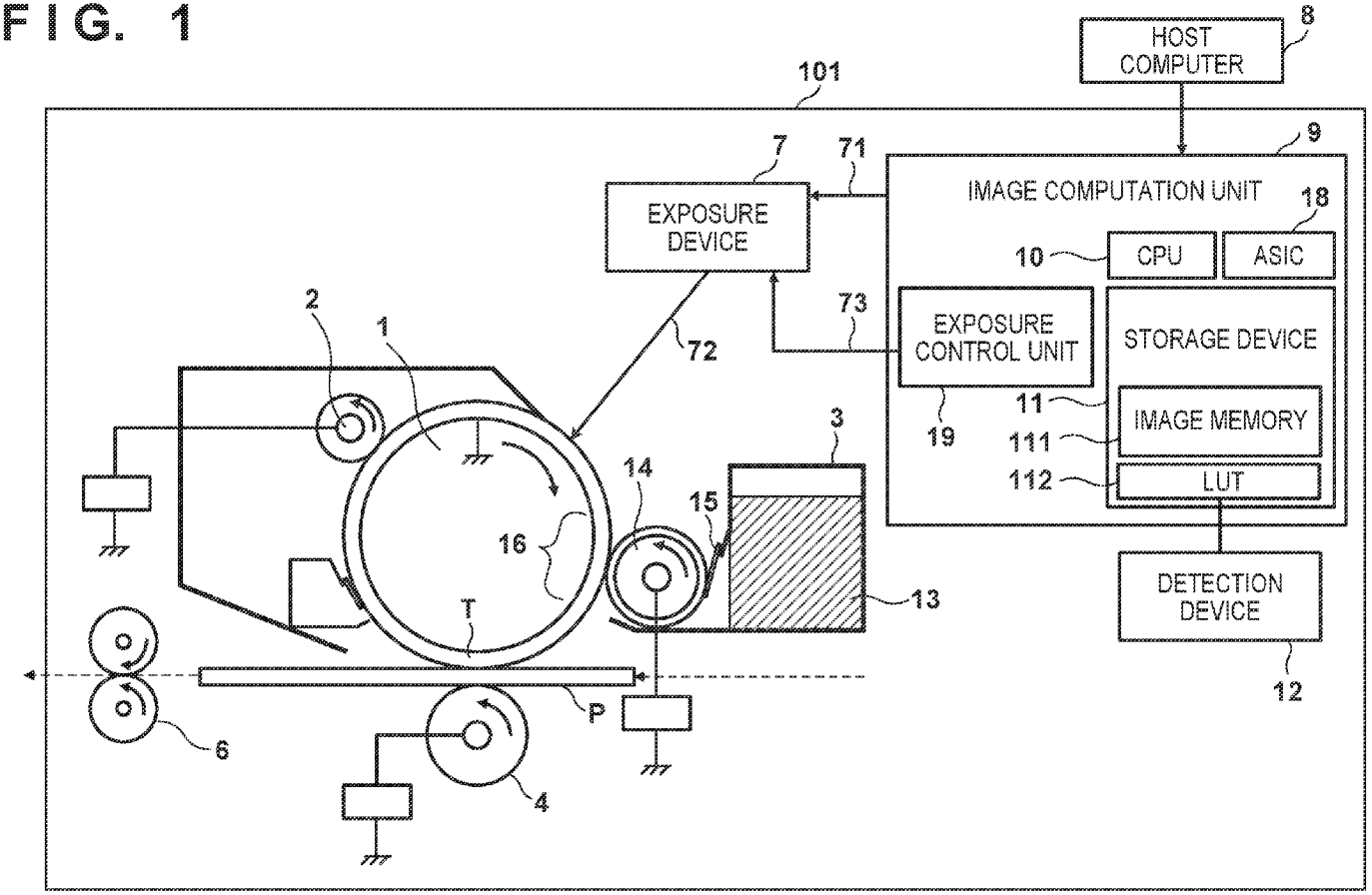
FIG. 1 is an overall cross-sectional view of an image forming apparatus.

Operations of an image forming apparatus 101 will be described with reference to FIG. 1. The image forming apparatus 101 includes a drum-shaped electrophotographic photosensitive member (called a "photosensitive drum" hereinafter) 1 serving as an image carrier. A charging device 2 such as a charging roller, serving as a charging unit, uniformly charges a surface of the photosensitive drum 1. An exposure device 7 such as a laser beam scanner device, a surface light-emitting element, or the like, serving as an exposure unit, irradiates the uniformly-charged photosensitive drum 1 with light at an exposure amount based on image data, thus exposing the photosensitive drum 1. This exposure is carried out using a laser beam. As a result of the exposure, an electrostatic latent image is formed on the surface of the photosensitive drum 1.

The exposure device 7 receives a driving signal 71 for the exposure device 7 output by an image computation unit 9, and forms the electrostatic latent image by irradiating the photosensitive drum 1 with light 72 based on the driving signal 71. An exposure control unit 19 outputs a light intensity adjustment signal 73 to the exposure device 7 in order to adjust a target light intensity used during the exposure. As a result, a current at a set level is supplied to the exposure device 7, and the exposure intensity is controlled at a constant level. Tones in the image can be expressed by adjusting the light intensity for each pixel based on the target light intensity, adjusting a light-emission time through pulsewidth modulation, or the like.

The image computation unit 9 executes a correction process for reducing a toner consumption amount, based on physical parameters detected by a detection device 12. In the present embodiment, the toner consumption amount is reduced by suppressing excess toner from adhering due to the edge effect, sweeping, or the like. The image computation unit 9 receives raster data (image data) sent from an image scanner, a host computer 8, or the like, and executes the correction process so that the toner consumption amount is reduced.

The "edge effect" referred to here is a phenomenon in which developing material adheres excessively to borders (edges) between a region of the surface of the photosensitive drum 1 that has been exposed (an exposed region) and a region that has not been exposed (an unexposed region). The surface potential in the exposed region is different from the surface potential in the unexposed region, and thus an electrical field leaks at these borders, resulting in excessive developing material adhering.

"Sweeping", meanwhile, is a phenomenon in which excessive developing material adheres at a following end portion of the electrostatic latent image in a transport direction thereof. Such excessive adhering of the developing material not only reduces the reproducibility of the density of the original document in the target image, but also results in excessive developing material being consumed. As such, developing material can be conserved by suppressing the developing material from being excessively consumed.

A CPU 10 is a control unit that carries out overall control of the image forming apparatus 101 as a whole. The CPU 10 functions as, for example, a correcting unit that reduces the edge effect or sweeping in the developing material by correcting the pixel values of pixels, among a plurality of pixels that configure the image data, in which the edge effect or sweeping in the developing material can occur. The CPU 10 may also function as a specifying unit that specifies pixels, among the plurality of pixels that configure the image data, in which the developing material may become excessive due to the edge effect or sweeping in the developing material. Part or all of the CPU 10 described hereinafter may be realized using an ASIC 18. A storage device 11 includes an image memory 111, and stores an LUT 112. The exposure control unit 19 sets the target light intensity by, for example, executing APC (automatic photometric control) for a light source in the exposure device 7. The image memory 111 is a storage region (a page memory, a line memory, or the like) in which image data to be formed as an image is expanded. The LUT 112 is a lookup table, and stores correction values for exposure amounts and the like in order to reduce the edge effect, sweeping, and so on. For example, correction values corresponding to the physical parameters detected by the detection device 12 are read out from the LUT 112. The detection device 12 detects parameters that are necessary for determining the correction values and that have correlation with the edge effect, sweeping, and so on. The physical parameters are, for example, an ambient temperature, an ambient humidity, a number of images formed, a total operating time of the image forming apparatus 101, a remaining lifespan of the photosensitive drum 1, a resistance value of the surface of the photosensitive drum 1, a remaining lifespan of toner 13, or the like. A single type of physical parameter may be used, or a plurality of types may be used. Although the LUT 112 of the storage device 11 functions here as a storage unit that stores the physical parameters and pixel value correction amounts in association with each other, the LUT 112 may also be employed as a storage unit that stores the physical parameters and a pixel number in association with each other. This makes it easy for the CPU 10 to specify the pixels that are to be corrected.

A developing device 3, serving as a developing unit, includes a toner receptacle that holds and stores developing material ("toner" hereinafter) 13, and a developing roller 14 that serves as a developing material carrier. Although a nonmagnetic single-component toner is used as the toner 13 here, a two-component toner may be employed, and a magnetic toner may be employed as well. The thickness of a layer of the toner 13 supplied to the developing roller 14 is regulated by a regulating blade 15 that functions as a toner layer thickness regulating member. The regulating blade 15 may be configured to impart an electrical charge on the toner 13. The toner 13 that has been regulated to a predetermined layer thickness and on which a predetermined electrical charge has been imparted is then transported to a developing region 16 by the developing roller 14. The developing region 16 is a region where the developing roller 14 and the photosensitive drum 1 are near to each other or are in contact with each other, and is a region where the toner actually adheres. The electrostatic latent image formed on the surface of the photosensitive drum 1 is developed by the toner 13 and converted into a toner image. The toner image formed on the surface of the photosensitive drum 1 is then transferred onto a transfer material P by a transfer device 4 at a transfer position T. The toner image that has been transferred onto the transfer material P is then transported to a fixing device 6. The fixing device 6 fixes the toner image onto the transfer material P by applying heat and pressure to the toner image and the transfer material P.

Development Schemes

Figure 2A:
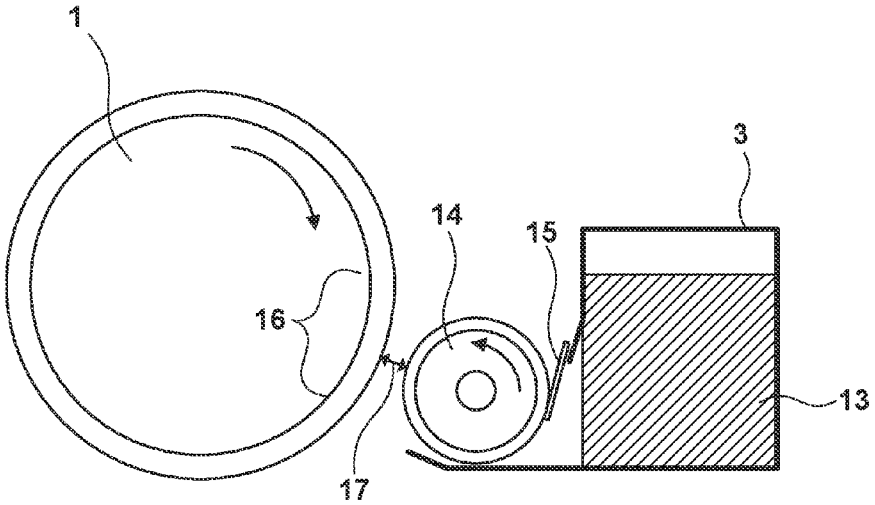
FIG. 2A is a diagram illustrating a non-contact development scheme.
Figure 2B:
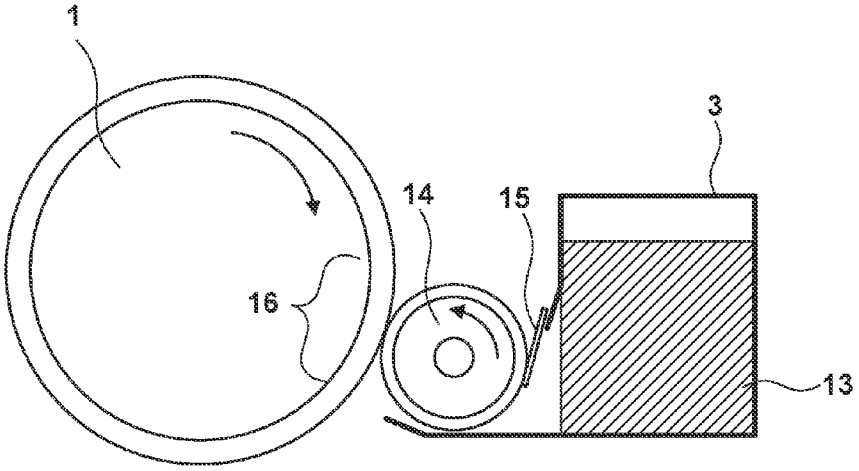
FIG. 2B is a diagram illustrating a contact development scheme.

A development scheme will be described next with reference to FIGS. 2A and 2B. Primarily, there is a jumping development scheme and a contact development scheme. The jumping development scheme is a scheme that develops using a developing voltage (an AC bias voltage combined with a DC bias or the like) applied between the developing roller 14 and the photosensitive drum 1 at the developing region 16, which is located at an area where the developing roller 14 and the photosensitive drum 1 are closest to each other while remaining in a non-contact state. FIG. 2A illustrates an example of the developing device 3 that uses the jumping development scheme. The developing device 3 that uses the jumping development scheme has a gap 17 between the developing roller 14 and the photosensitive drum 1 at a developing position. If the gap 17 is too small, it is easy for leaking to occur from the developing roller 14 to the photosensitive drum 1, which makes it difficult to develop the latent image. If the gap 17 is too large, it is difficult for the toner 13 to jump to the photosensitive drum 1. Accordingly, the gap 17 may be kept at a proper size by a butting roller rotatably supported on a shaft of the developing roller 14.

The contact development scheme is a scheme that develops the toner 13 using a developing voltage (AC bias) applied between the developing roller 14 and the photosensitive drum 1 at the developing region 16, which is located at an area where the photosensitive drum 1 and the developing roller 14 are closest to and in contact with each other. FIG. 2B illustrates an example of the developing device 3 that uses the contact development scheme.

The photosensitive drum 1 and the developing roller 14 rotate in the forward direction at mutually different speeds. Although an AC voltage is applied as the developing voltage between the photosensitive drum 1 and the developing roller 14, the polarity of the developing voltage may be set to the same polarity as the charging potential of the surface of the photosensitive drum 1. The toner 13 that has been formed as a thin layer upon the developing roller 14 is transported to the developing region 16, and the electrostatic latent image formed on the surface of the photosensitive drum 1 is developed.

Principles of Occurrence of Edge Effect

Figure 3:
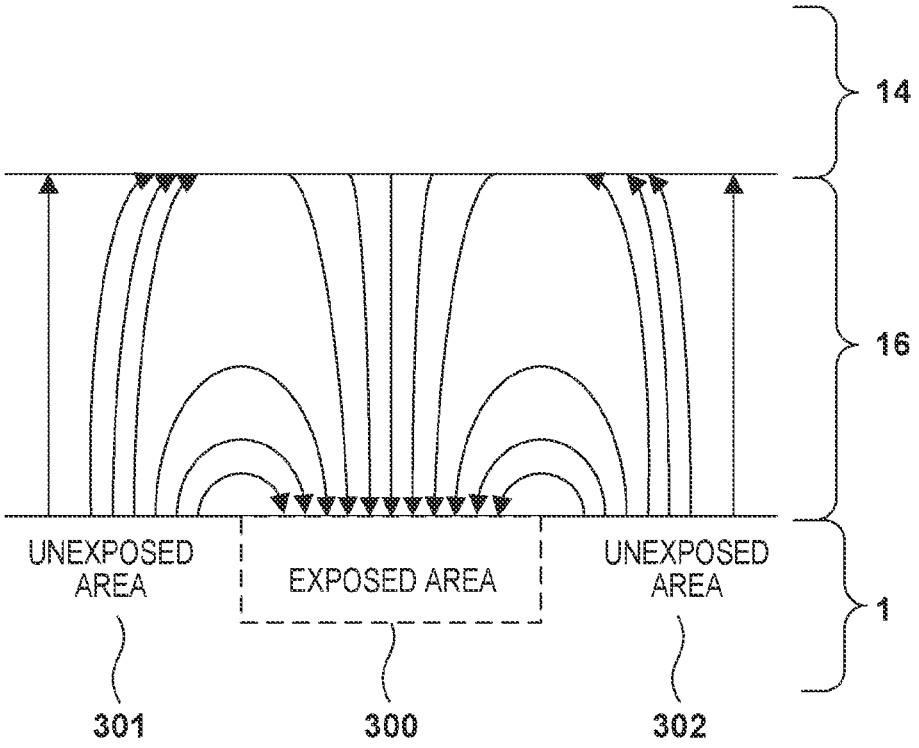
FIG. 3 is a diagram illustrating an electrical field in an electrostatic latent image when an image carrier and a developing material carrier are not in contact.

The edge effect is a phenomenon in which an electrical field concentrates at a border between an exposed area (the electrostatic latent image) formed on the photosensitive drum 1 and an unexposed area (a charged area), causing excessive toner 13 to adhere to edges of the image. As shown in FIG. 3, electric lines of force from unexposed areas 301 and 302 that surround an exposed area 300 circle around edges of the exposed area 300, and thus the electrical field intensity at the edges is higher than at the center of the exposed area 300. In other words, more toner adheres to the edges than the center of the exposed area 300.

Figure 4A:
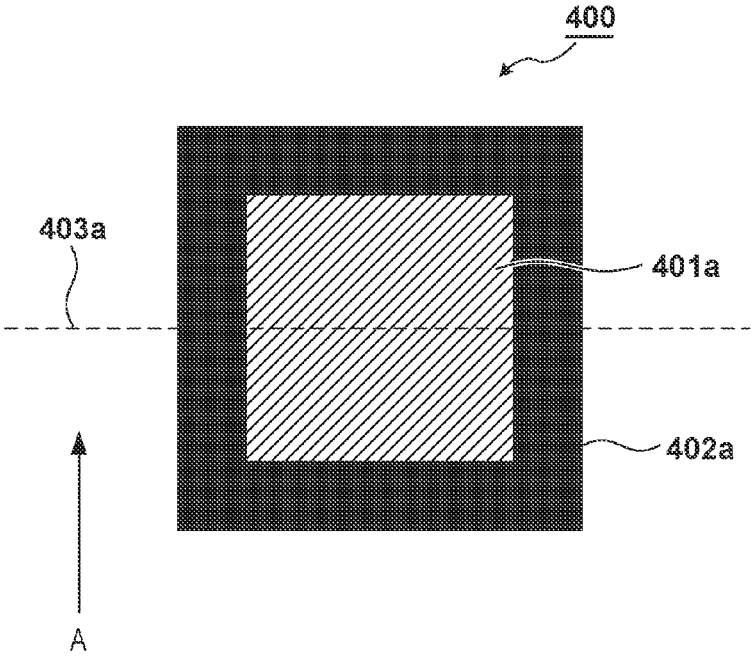
FIG. 4A is a diagram illustrating a toner image in which the edge effect is present.

FIG. 4A illustrates an example of a toner image in which the edge effect is present. An arrow A indicates the transport direction of the toner image (the direction in which the photosensitive drum 1 rotates; also called the "sub-scanning direction"). In image data serving as the basis of a toner image 400, the toner image 400 is an image having a uniform density. In the case where the edge effect has occurred, the toner 13 adheres in a concentrated manner at an edge area 402*a* of the toner image 400. As a result, there is a greater image density at the edge area 402*a* than at a non-edge area 401*a*. Because excessive toner 13 adheres to the edge area 402*a* in this manner, more toner 13 will be consumed than is necessary. Furthermore, the toner density of the toner image will no longer be uniform. The electrical field intensity at the edge area 402*a* varies depending on the environment in which the image forming apparatus 101 is installed, the remaining lifespan of the photosensitive drum 1 and the toner 13, and so on, and as result, the range and intensity at which the edge effect occurs also varies. Accordingly, the range and intensity at which the edge effect occurs can be specified by the detection device 12 detecting the environment, remaining lifespan, and so on, which makes it possible to precisely correct the edge effect.

Figure 5A:
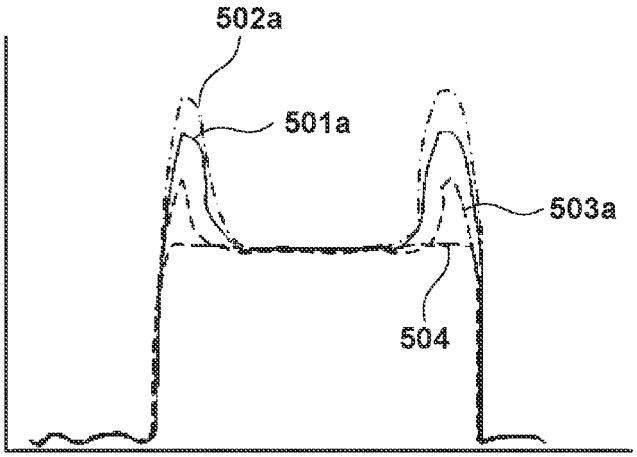
FIG. 5A is a diagram illustrating a toner height in a toner image in which the edge effect is present.

A height of the toner image in the case where the edge effect has occurred will be described using FIG. 5A. FIG. 5A is a cross-sectional view obtained by cutting the toner image 400 shown in FIG. 4A along a cut line 403*a*. 504 indicates an ideal toner image height in the case where the edge effect has not occurred. 501*a* to 503*a* indicate toner image heights based on differences in the intensity of the edge effect. 502*a* indicates the highest intensity of the edge effect, whereas 503*a* indicates the lowest intensity of the edge effect. It can thus be seen that the height of the toner image at the edge areas increases due to the occurrence of the edge effect, and excessive toner 13 is used.

In the jumping development scheme, the edge effect occurs in this manner due to an electrical field concentrating at the edge areas. Meanwhile, in the contact development scheme, the gap 17 is extremely narrow, and the electrical field travels from the photosensitive drum 1 toward the developing roller 14; as such, the concentration of the electrical field at the edge areas is reduced, which makes it difficult for the edge effect to occur.

Principles of Occurrence of Sweeping

Figure 4B:
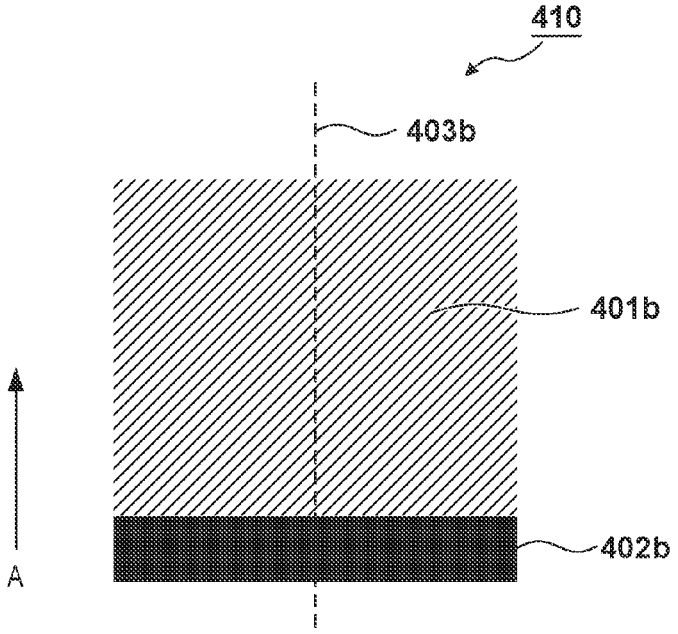
FIG. 4B is a diagram illustrating a toner image in which sweeping is present.

Sweeping occurring in a contact development scheme will be described next. Sweeping refers to a phenomenon in which the toner 13 concentrates at an edge in the following end portion of an image on the photosensitive drum 1, as shown in FIG. 4B. The "following end portion" refers to a following end portion of the toner image in the transport direction of the toner image (that is, the rotational direction of the photosensitive drum 1) indicated by the arrow A. When sweeping occurs, the density at a following edge portion 402*b* of the toner image 410 becomes greater than the density at a non-edge portion 401*b*, as shown in FIG. 4B; this results in an increased amount of the toner 13 being consumed.

Figure 6:
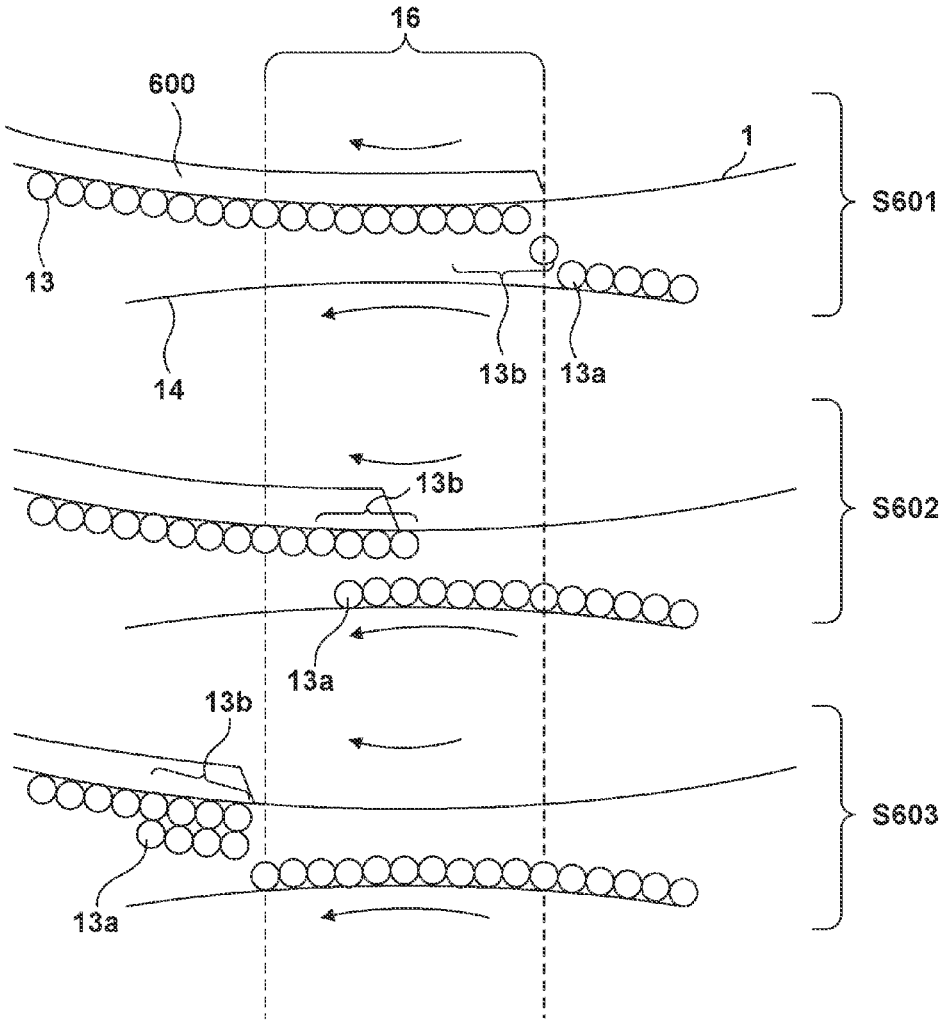
FIG. 6 is a diagram illustrating a generation mechanism of sweeping.

As shown in FIG. 6, in the contact development scheme, the developing roller 14 is rotated at a higher speed than the photosensitive drum 1 in order to ensure the toner height on the photosensitive drum 1 is a predetermined height. This makes it possible to supply the toner 13 to the photosensitive drum 1 in a stable manner, which in turn keeps the image density at a target density. As indicated by S601, the electrostatic latent image is developed at the developing region 16, using the toner 13 transported by the developing roller 14. Because the developing roller 14 is rotating at a higher speed than the photosensitive drum 1, the positional relationship between the surfaces of the two is in a consistent state of skew. As such, when the following end portion of an electrostatic latent image 600 enters the developing region 16, toner 13*a* on the developing roller 14 is located further backward from a following end portion 13*b* of the electrostatic latent image 600, behind the starting position of the developing region 16, in the rotational direction, as indicated by S601. Then, as shown in S602, the toner 13*a* on the developing roller 14 overtakes the following end portion 13*b* of the electrostatic latent image 600 before the following end portion 13*b* of the electrostatic latent image 600 exits the developing region 16. Then, as shown in S603, the toner 13*a* is supplied to the following end portion 13*b* of the electrostatic latent image 600, increasing the developing amount at the following end portion 13*b*. This is the mechanism through which sweeping occurs.

The electrical field intensity at the following end portion varies depending on the environment in which the image forming apparatus 101 is installed, the remaining lifespan of the photosensitive drum 1 and the toner 13, and so on, and as result, the intensity at which sweeping occurs also varies. Furthermore, the rotational speed of the photosensitive drum 1 and the rotational speed of the developing roller 14 also vary depending on the environment in which the image forming apparatus 101 is installed, the remaining lifespan of the photosensitive drum 1 and the toner 13, and so on. This in turn causes variation in the range in which the toner 13*a* overtakes the following end portion of the electrostatic latent image 600, and variation in the range across which sweeping occurs.

Figure 5B:
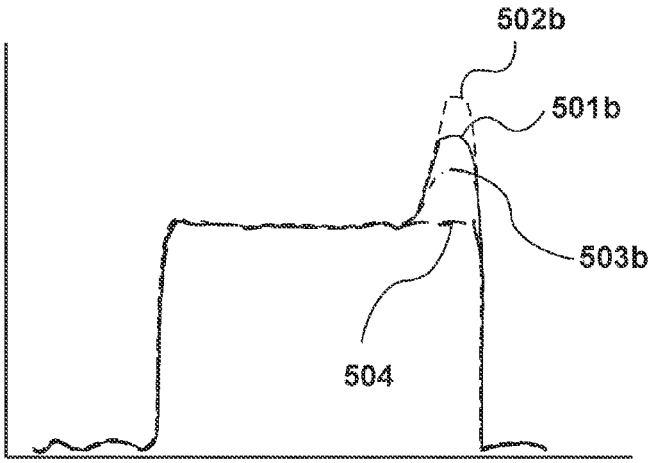
FIG. 5B is a diagram illustrating a toner height in a toner image in which sweeping is present.

A height of the toner image in the case where sweeping has occurred will be described using FIG. 5B. FIG. 5B is a cross-sectional view obtained by cutting the toner image 410 shown in FIG. 4B along a cut line 403*b*. In FIG. 5B, the height of the toner image is greater at areas 501*b*, 502*b*, and 503*b* where sweeping occurs, indicating that an excessive amount of toner 13 is being used. Note that the areas 501*b*, 502*b*, and 503*b* where sweeping occurs are examples in which there are different respective intensities of sweeping.

As described thus far, the intensities at which the edge effect and sweeping occur correlate with the surrounding environment of the image forming apparatus 101, the remaining lifespan of the photosensitive drum 1 and the toner 13, and so on. Using the total number of images formed, the total operating time, or the like of the image forming apparatus 101 can be given as methods for detecting the remaining lifespan of the photosensitive drum 1 and the toner 13, for example. Note that these physical parameters are reset to zero when the photosensitive drum 1, a process cartridge including the developing roller 14 and the toner receptacle, or the like is replaced. The detection device 12 may find a surface resistance value of the photosensitive drum 1 by detecting a current that flows when a charging voltage, the developing voltage, and a transfer voltage are applied to the photosensitive drum 1. This is because the surface resistance value also correlates with the remaining lifespan of the photosensitive drum 1.

Exposure Device Control Method

Figure 7:
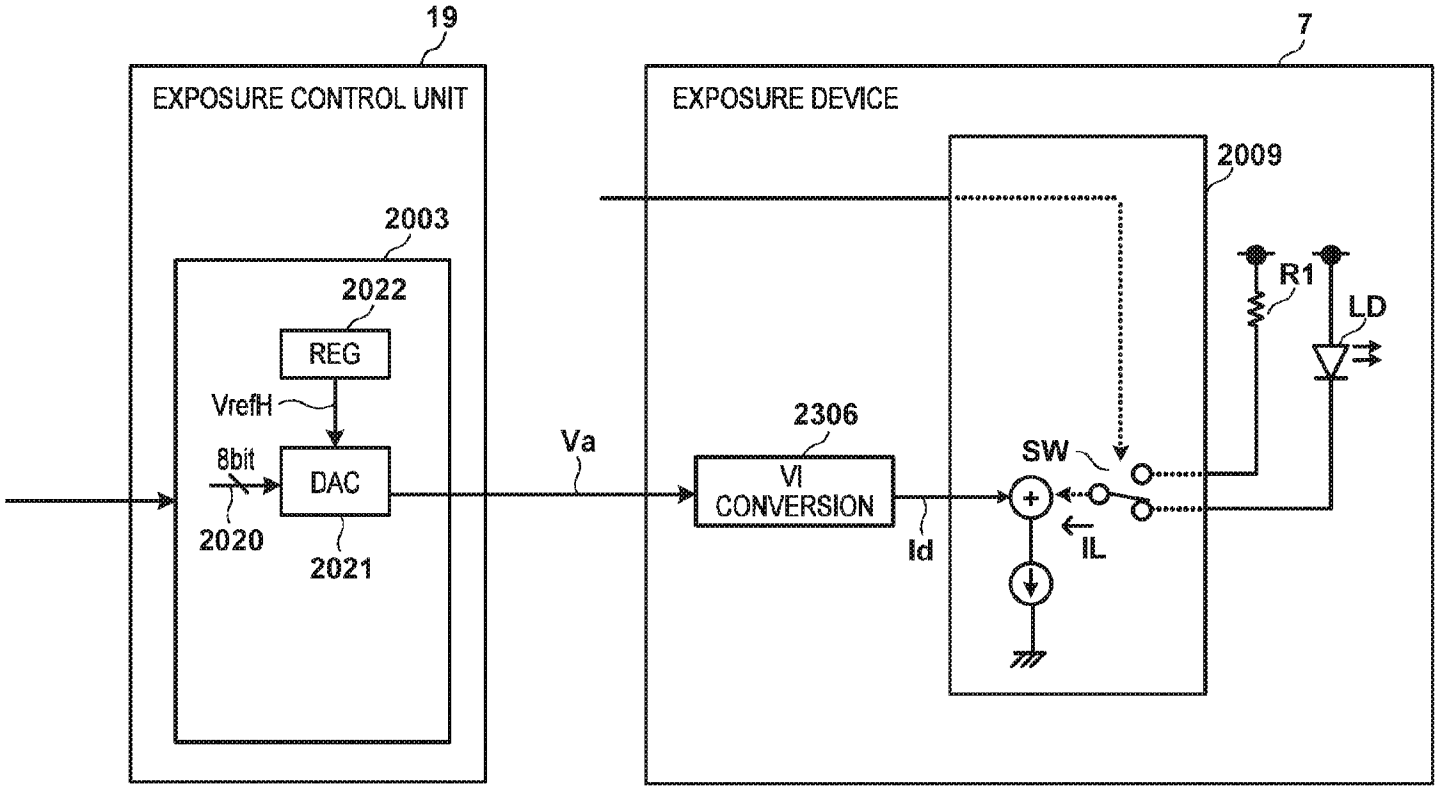
FIG. 7 is a diagram illustrating units involved in exposure processing.

A method for controlling the exposure device 7 will be described next using FIG. 7. The exposure control unit 19 includes an IC 2003 provided with an 8-bit DA converter 2021 and a regulator 2022, and generates and issues signals for controlling the exposure device 7. Meanwhile, the exposure device 7 is provided with a VI conversion circuit 2306 that converts a voltage into a current, a laser driver IC 2009, and a semiconductor laser LD. The IC 2003 adjusts a voltage VrefH outputted from the regulator 2022 based on the light intensity adjustment signal 73, which indicates a driving current for the semiconductor laser LD set by the CPU 10. The voltage VrefH serves as a reference voltage for the DA converter 2021. By the IC 2003 setting input data 2020 for the DA converter 2021, the DA converter 2021 outputs a light intensity correction analog voltage Va. The VI conversion circuit 2306 converts the light intensity correction analog voltage Va into a current value Id and outputs that value to the laser driver IC 2009. In FIG. 7, the IC 2003 provided in the exposure control unit 19 outputs the light intensity correction analog voltage Va. However, the DA converter 2021 may be provided in the exposure device 7, and the light intensity correction analog voltage Va may be generated in the vicinity of the laser driver IC 2009.

The laser driver IC 2009 switches a switch SW based on the driving signal 71 output by the image computation unit 9. The switch SW turns the semiconductor laser LD on and off by switching between supplying a current IL to the semiconductor laser LD and supplying the current IL to a dummy resistance R1.

Exposure Amount Correction Method

Figure 8A:
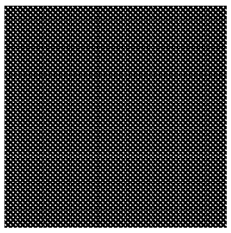
FIGS. 8A-8C are diagrams illustrating changes in the density of a toner image produced by changing an exposure method.
Figure 8B:
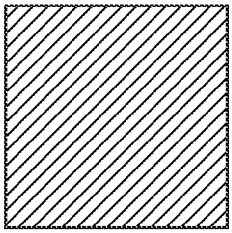
Figure 8C:
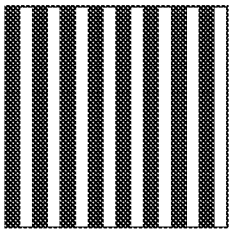

FIG. 8A illustrates an image formed by exposing a single pixel at 100% of the target light intensity. FIG. 8B illustrates an image formed by exposing a single pixel having reduced the light intensity thereof to 50% of the target light intensity. This can be realized by reducing the exposure intensity to 50%, halving the density (tone value) of the toner image, or the like. FIG. 8C illustrates thinning out of an image formed by dividing a single pixel into N (where N is a natural number of 2 or more) sub pixels and partially thinning out the sub pixels. The thinning out is to reduce light amount on an area to be exposed with light or reduce an area to be exposed with light. This can be realized by, for example, carrying out PWM (pulsewidth modulation) on a light intensity at 100% of the target light intensity. This process can be realized by, for example, dividing a single pixel into 16 sub pixels and driving the semiconductor laser LD to expose only odd-numbered sub pixels.

Edge Effect Correction Procedure

Next, a working example that reduces the edge effect and reduces the amount of the toner 13 that is consumed by correcting the image data used to form the electrostatic latent image will be described. As already described, the intensity of the edge effect varies depending on the remaining lifespan, the surrounding environment, and so on of the photosensitive drum 1 and the toner 13. Accordingly, relationships between conditions such as the physical parameters that correlate with the edge effect and exposure amount correction values for eliminating the edge effect are found in advance through experiments, simulations, or the like, and are then stored in the LUT 112. Accordingly, the appropriate correction values are read out from the LUT 112 based on the conditions detected by the detection device 12.

Figure 9:
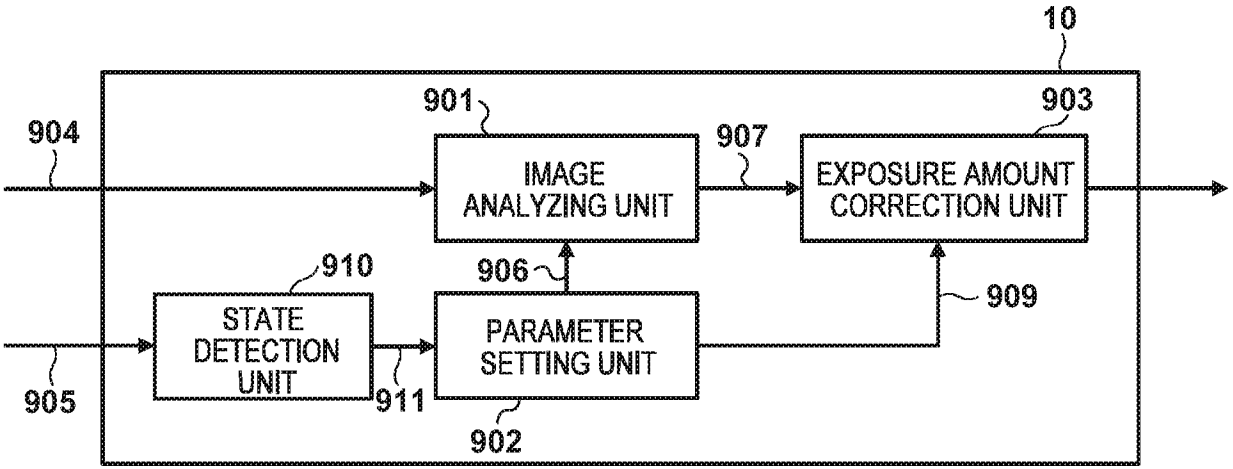
FIG. 9 is a diagram illustrating an example of functions realized by a CPU.

A processing method for correcting the edge effect will be described using FIG. 9. A correction process for reducing the edge effect is executed by the CPU 10 or the ASIC 18 of the image computation unit 9. The descriptions given here assume that the CPU 10 executes the correction process. Although the exposure intensity is corrected in order to reduce the edge effect, sweeping, and so on, there are two methods for correcting the exposure intensity. The first is a method that corrects the driving signal 71 for the exposure device 7, and the second is a method that corrects the light intensity adjustment signal 73.

The edge effect correction process is a correction process that reduces the edge effect or sweeping in the developing material by correcting the pixel values of pixels, among a plurality of pixels that configure the image data, in which the edge effect or sweeping in the developing material can occur. The correction process may, for example, include a step of specifying pixels, among the plurality of pixels that configure the image data, in which the developing material may become excessive due to the edge effect or sweeping in the developing material. The correction process may furthermore include a step of finding a pixel region configured of pixels, among the plurality of pixels that configure the image data, having pixel values that are greater than or equal to a predetermined value, and specifying a predetermined number of pixels from the pixels located at the edges of the pixel region as pixels in which the developing material will become excessive due to the edge effect.

Image data 904 sent from the host computer 8 is stored in the image memory 111. An image analyzing unit 901 specifies pixels, among the plurality of pixels that configure the image data 904 in the image memory 111, in which the edge effect can occur, based on a correction range parameter set by a parameter setting unit 902, and outputs an analysis result 907. The edge effect is reduced by correcting the exposure intensities of the specified pixels, which in turn reduces the amount of the toner 13 that is consumed. The correction range parameter indicates a number of pixels from the edge of an image region in which the toner is used. For example, when the correction range parameter is 1, each first pixel from the edge of the image region is a target for correction. In this manner, the image analyzing unit 901 functions as a pixel number determination unit that determines a predetermined number of pixels to be corrected based on the physical parameters detected by the detection device 12.

A state detection unit 910 receives state information 905 from the detection device 12, recognizes what state the image forming apparatus 101 is in, and outputs condition information 911, corresponding to the recognized state, to the parameter setting unit 902. The state information 905 may be the temperature, humidity, and the like of the environment in which the image forming apparatus 101 is installed, the total number of images formed, the total operating time, and so on of the image forming apparatus 101; or may be information indicating the remaining lifespan of the photosensitive drum 1, the toner 13, or the like predicted based on those pieces of information. In this manner, the state detection unit 910 may function as a physical parameter detection unit along with the detection device 12.

The parameter setting unit 902 receives the condition information 911 and sets the correction range parameter 906 and an exposure amount adjustment parameter 909 in an exposure amount correction unit 903, as exposure amount correction parameters. In this manner, the parameter setting unit 902 functions as a correction amount determination unit that determines a correction amount for the pixel value of the correction target pixel based on the physical parameters detected by the detection device 12. In the case where the light intensity adjustment signal 73 is corrected instead of the driving signal 71, the parameter setting unit 902 outputs the adjustment parameter 909 for correcting the light intensity adjustment signal 73.

FIGS. 10A to 10C illustrate examples of the LUT 112. The LUT 112 stores several conditions correlated with the intensity of the edge effect in association with the correction range parameter and the exposure amount adjustment parameter. FIG. 10A illustrates the LUT 112 used for a standard temperature and a standard humidity. FIG. 10B illustrates the LUT 112 used at a lower temperature than the standard temperature and a lower humidity than the standard humidity. FIG. 10C illustrates the LUT 112 used at a higher temperature than the standard temperature and a higher humidity than the standard humidity. Based on the temperature and humidity detected by the detection device 12, the state detection unit 910 selects one of the LUTs 112 and communicates the selected LUT 112 to the parameter setting unit 902.

Conditions 1-4 indicate four levels for the remaining lifespan, for example. The number of conditions is determined in accordance with density characteristics and the like of the photosensitive drum 1, the toner 13, and so on that are used. Here, it is assumed that the maximum number of images that can be formed using a new process cartridge is 4,000. The condition 1 is determined for the case where the total number of images formed is 0 to 1,000. The condition 2 is determined for the case where the total number of images formed is 1,001 to 2,000. The condition 3 is determined for the case where the total number of images formed is 2,001 to 3,000. The condition 4 is determined for the case where the total number of images formed is 3,001 to 4,000. The detection device 12 counts the total number of images formed and communicates the total number of images formed as part of the state information 905. The state detection unit 910 determines how to classify the conditions based on the total number of images formed, and outputs information indicating the determined condition to the parameter setting unit 902 as the condition information 911. The parameter setting unit 902 refers to the LUT 112 based on the condition indicated in the condition information 911, and reads out the correction range parameter and adjustment parameter corresponding to the condition. For example, in the case where the temperature and humidity detected by the detection device 12 are the standard temperature and the standard humidity, the LUT 112 indicated in FIG. 10A is selected. Furthermore, in the case where the total number of images formed as detected by the detection device 12 is 500, six pixels are selected from the LUT 112 for the correction range parameter 906, and 50% is selected as a toner reduction amount for the adjustment parameter 909. The correction process is not executed in the case where the conditions derived from the physical parameters detected by the detection device 12 do not correspond to any of the conditions 1 to 4. A condition in which the edge effect does not occur may be added to the LUT 112 as condition 5. The correction range parameter 906 and the adjustment parameter 909 stored in association with the condition 5 are 0 and 0%, respectively.

In this manner, in the first working example, the edge effect correction process is switched in accordance with the physical parameters correlated with the edge effect. Although the surrounding environment information, total number of images formed, and the like are employed here as an example of the state information 905, any information can be employed as long as it is information related to the remaining lifespan of the photosensitive drum 1, the toner 13, and the like. The remaining lifespan information described here may be data that directly indicates the remaining lifespan, or may be one or a combination of a past total operating time, a past total number of images formed, or the like for the photosensitive drum 1. The parameters required for the edge effect correction process may, for example, be measured after the image forming apparatus 101 is assembled, and may then be stored.

Figures 11A, 11B, 11C:
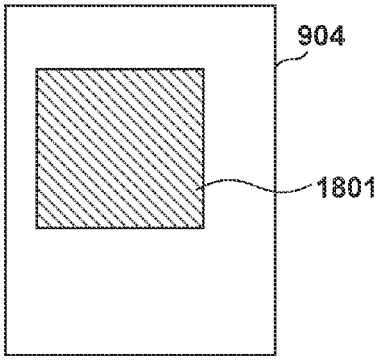
FIG. 11A is a diagram illustrating an example of image data.
FIG. 11B is a diagram illustrating an example of a pixel value for each pixel of which an image region is configured.
FIG. 11C is a diagram illustrating an example of a pixel specified as a correction target pixel.

Operations performed by the image analyzing unit 901 will be described next using FIGS. 11A to 11C. FIG. 11A indicates the image data 904. The image analyzing unit 901 receives the image data 904 from the image memory 111 in raster order. The image analyzing unit 901 specifies the pixels, among the plurality of pixels of which the received image data 904 is configured, that are to be corrected, based on the correction range parameter set by the parameter setting unit 902. It is assumed here that the edge effect correction range is three pixels. An image region 1801 indicates an image region, of the image data 904, in which the toner 13 is to be reduced.

FIG. 11B illustrates a pixel value for each pixel of which the image region 1801 is configured. FIG. 11B illustrates an extreme example, in which the pixel value of black pixels is 255 and the pixel value of white pixels is 0. FIG. 11C illustrates an example of pixels specified by the image analyzing unit 901 as correction target pixels based on the correction range parameter. A value of 1 is assigned to correction target pixels, and a value of 0 is assigned to pixels that are not to be corrected. Three pixels from the edges of the image region 1801 are specified as correction target pixels. The image analyzing unit 901 outputs the analysis result 907, indicating correction target pixels such as those shown in FIG. 11C, to the exposure amount correction unit 903.

The exposure amount correction unit 903 corrects the pixel values (exposure amounts) of the respective pixels in accordance with the analysis result 907 and the adjustment parameter 909 set by the parameter setting unit 902, generates the driving signal 71 based on the corrected pixel values, and outputs the generated signal to the exposure device 7. As described above, the light intensity adjustment signal 73 may be corrected instead of the driving signal 71. When the driving signal 71 is corrected, the exposure interval is corrected and the toner amount per pixel is reduced, as indicated in FIG. 8C. When the light intensity adjustment signal 73 is corrected, the exposure amount is reduced in order to reduce the image density in each pixel, as indicated in FIG. 8B.

Figure 12:
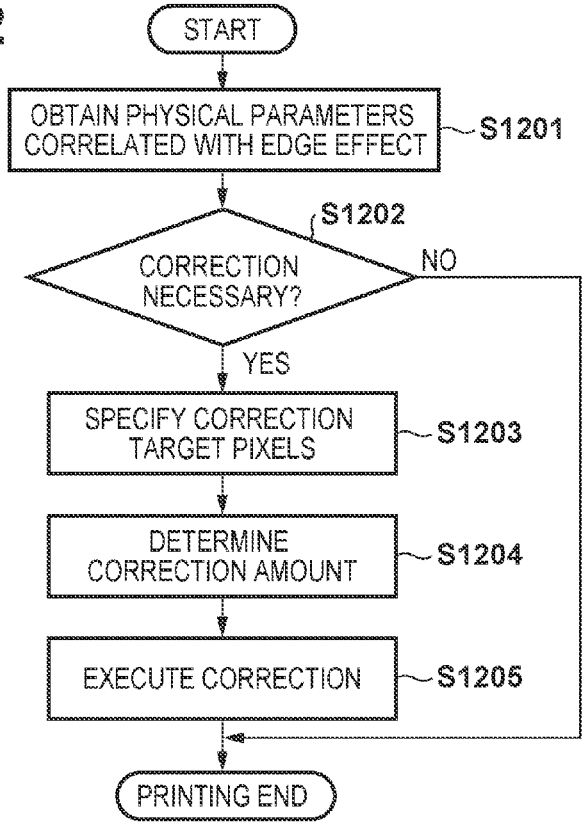
FIG. 12 is a flowchart illustrating a correction process.

FIG. 12 is a flowchart illustrating the respective steps of the correction process executed by the CPU 10. The CPU 10 starts processing according to this flowchart upon receiving an instruction to start printing from the host computer 8.

In S1201, the CPU 10 obtains the physical parameters detected by the detection device 12 from the detection device 12.

In S1202, the CPU 10 compares the physical parameters obtained from the detection device 12 with a predetermined determination condition and determines whether the edge effect correction process is necessary. For example, the CPU 10 selects the LUT 112 based on the temperature, humidity, and so on detected by the detection device 12, and obtains a correction range, adjustment amount, and the like based on the total number of images formed as detected by the detection device 12. In the case where the correction range, adjustment amount, and so on are zero, it is determined that the edge effect need not be corrected, and the process ends. However, in the case where the correction range, adjustment amount, and so on are not zero, the CPU 10 determines that correction is necessary, and the process moves to S1203.

In S1203, the CPU 10 specifies the correction target pixels in the image data based on the physical parameters obtained from the detection device 12. As described using FIGS. 9, 10A to 10C, and 11A to 11C, the correction range parameter corresponding to the total number of images formed is read out from the LUT 112 selected based on the temperature, humidity, and so on. This step sets the number of pixels from the edges of the image region 1801 that are to be corrected.

In S1204, the CPU 10 determines a correction amount to be applied to the correction target pixels based on the physical parameters obtained from the detection device 12. As described using FIGS. 9, 10A to 10C, and 11A to 11C, the exposure amount adjustment parameter corresponding to the total number of images formed is read out from the LUT 112 selected based on the temperature, humidity, and so on.

In S1205, the CPU 10 corrects the exposure amounts of the respective correction target pixels by correcting the pixel values of the specified correction target pixel using the adjustment parameter. Although this example describes the CPU 10 as carrying out the correction process, the correction process may be executed by the ASIC 18 or the host computer 8. In this manner, the CPU 10, the ASIC 18, the host computer 8, or the like functions as an image processing apparatus.

Sweeping Correction

Figure 13:
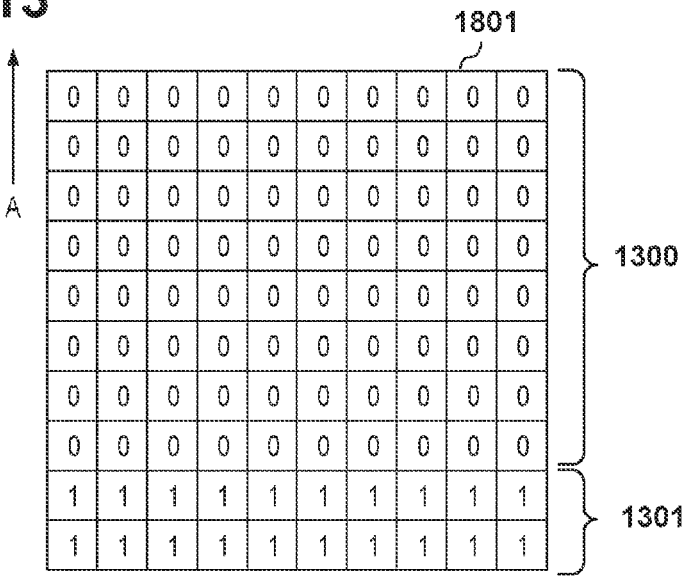
FIG. 13 is a diagram illustrating a method for specifying a sweeping correction target pixel.

Sweeping correction employs almost the same process as the edge effect correction. FIG. 13 illustrates pixels 1301 that are to be corrected for sweeping and pixels 1300 that need not be corrected. FIG. 13 corresponds to FIG. 11C. As shown in FIG. 13, the pixels in the image region 1801 on the following end side in the transport direction indicated by the arrow A have been specified by the image analyzing unit 901 of the CPU 10 as targets for correction. This example corresponds to a case where the correction range parameter obtained by the parameter setting unit 902 from the LUT 112 is two pixels. Accordingly, two pixels from the following edge of the image region 1801 are specified as correction target pixels. As such, aside from the correction target pixels being different, the sweeping correction and edge effect correction are almost the same correction process.

Other

The aforementioned working example describes holding conditions correlated with the intensity of the edge effect, and the correction range and adjustment amount, using a lookup table. However, a function having the same effect may be employed instead of a lookup table. An approximated curve function that enables the correction range to be computed from the conditions, an approximated curve that enables the adjustment amount to be computed from the conditions, or the like are examples of such a function. Although a one-dimensional approximated straight line is described here as an example of the function, the function may employ a two-dimensional, three-dimensional, or multi-dimensional approximated curve.

Coefficients that define the approximated curve are necessary in order to find the approximated curve indicating the correction range, the adjustment amount, or the like corresponding to the conditions. For example, in the case of the standard temperature and the standard humidity shown in FIG. 10A, the slope is −1 and the intercept is 6, of the coefficients necessary for the approximated curve indicating the relationship between the conditions and the correction range. Accordingly, correction range $y1=-1*(\text{condition level } x)+6$ is obtained as the equation for the approximated curve. In the case of the example shown in FIG. 10A, the variable x indicating the condition level is any of 1 to 4. Likewise, it is assumed that the slope is −10 and the intercept is 50, of the coefficients necessary for the approximated curve indicating the exposure amount adjustment amount. In this case, adjustment amount $y2=-10*(\text{condition level } x)+50$ is obtained as the equation for the approximated curve. Coefficients for defining a function corresponding to the LUT 112 for low temperature and low humidity, a function corresponding to the LUT 112 for high temperature and high humidity, and so on are stored in the storage device 11 in the same manner. The CPU 10 then reads out the coefficients corresponding to the physical parameters detected by the detection device 12 from the storage device 11, generates the functions, and computes the correction range, adjustment amount, and so on from the generated functions.

In this manner, the same effects as when using the LUT 112 can be achieved by storing coefficients that define functions for finding the correction range, the adjustment amount, and so on. Compared to the LUT 112, coefficients require a significantly lower amount of storage space. As such, the amount of storage space taken up in the storage device 11 can be reduced.

Conclusion

According to the present embodiment, the image forming condition is corrected so that in the case where a specific pixel, of a plurality of pixels that configure the image data, has been specified as having a second developing material amount used in development performed by the developing unit that is greater than a first developing material amount determined by the image data, the second developing material amount at least approaches the first developing material amount. An increase in the amount of developing material consumed is suppressed by correcting pixels, among the plurality of pixels that configure the image data, in which the amount of developing material consumed increases beyond a desired amount.

According to the present embodiment, the pixel value of a pixel, among a plurality of pixels that configure the image data, in which the edge effect or sweeping can occur in the developing material, is corrected as the correction of the image forming condition. This reduces the edge effect or sweeping in the developing material. In other words, excessive consumption of the developing material is reduced, and the toner consumption amount is reduced as well. As a secondary effect, the density of the toner image will match an expected density based on the image data, resulting in improvement in terms of the image quality as well.

The CPU 10 may function as a specifying unit that specifies the specific pixel, of the plurality of pixels that configure the image data, having the second developing material amount consumed in the development performed by the developing unit that is greater than the first developing material amount corresponding to the image data. For example, the image analyzing unit 901 of the CPU 10 may specify pixels, among the plurality of pixels that configure the image data, in which the developing material will become excessive due to the edge effect or sweeping in the developing material, and correct the pixel values of the pixels specified by the exposure amount correction unit 903. Note that the image analyzing unit 901 may find a pixel region configured of pixels, among the plurality of pixels that configure the image data, having pixel values that are greater than or equal to a predetermined value, and specify a predetermined number of pixels from the pixels located at the edges of the pixel region as pixels in which the developing material will become excessive due to the edge effect. The edge effect, sweeping, and so on are more visually recognizable when the optical density of a pixel exceeds a given value. Furthermore, the edge effect occurs at the edges of the pixel region, whereas sweeping occurs at a following end of the pixel region. The edge effect, sweeping, and so on can be efficiently reduced by determining the correction target pixels taking these characteristics into account.

There is a correlation between the intensity of the edge effect, sweeping, or the like in the developing material and environment conditions where an image forming apparatus is installed (temperature, humidity, and so on), the remaining lifespan of components involved in developing (photosensitive members, developing materials, developing members, and so on). Accordingly, by using the detection device 12 to detect physical parameters that correlate with the edge effect or sweeping in the developing material and then determining the number of correction target pixels, the exposure amount correction amount, and so on, the edge effect or sweeping in the developing material can be reduced with precision. In this manner, the CPU 10 functions as a correcting unit that corrects an image forming condition (an exposure amount, for example) based on a physical parameter so that in the case where a specific pixel, of a plurality of pixels that configure the image data, has been specified as having a second developing material amount used in the development performed by the developing unit that is greater than a first developing material amount determined by the image data, the second developing material amount at least approaches the first developing material amount.

If the LUT 112 stores the physical parameters and the pixel number for the correction target pixels in association with each other, the parameter setting unit 902 can easily determine the pixel number for the correction target pixels based on the physical parameters detected by the detection device 12. Functions may be used instead of the LUT 112. In other words, the CPU 10 may compute the predetermined number of pixels by substituting the physical parameter detected by the detection device 12 in the function. In this case, the LUT 112 need only store coefficients defining the functions, which makes it possible to reduce the amount of storage space used.

Likewise, if the LUT 112 stores the physical parameters and the pixel value correction amounts in association with each other, the parameter setting unit 902 can easily determine the pixel value correction amount (exposure amount) based on the physical parameters detected by the detection device 12.

The physical parameters correlated with the edge effect or sweeping are an ambient temperature, an ambient humidity, a number of images formed, a total operating time of the image forming apparatus, a remaining lifespan of the image carrier, a surface resistance value of the image carrier, a remaining lifespan of the developing material, and the like, for example. The CPU 10 can predict the intensity of the edge effect or sweeping by using at least one of these parameters.

Directly correcting the pixel values (tone values/density values) in the image data, indirectly correcting the pixel values by correcting exposure amounts, and so on can be given as examples of correction methods. The exposure amount correction unit 903 may correct the exposure amounts for pixels in which the edge effect or sweeping in the developing material can occur. Alternatively, the exposure amount correction unit 903 may divide the pixel in which the edge effect or sweeping in the developing material may occur into N sub pixels (where N is a natural number of 2 or more) and thin out at least one of the N sub pixels.

Although the present embodiment describes the correction process as being executed by an image processing apparatus (the image computation unit 9) provided in the image forming apparatus 101, the image processing apparatus may be a computer installed outside of the image forming apparatus 101. In other words, the host computer 8, the CPU 10 of the image computation unit 9, or the like may function as a supply unit for supplying image data to the image forming apparatus, an image processing apparatus, or the like. In addition, the CPU 10 may execute the image processing method illustrated in FIG. 12 by executing programs stored in the storage device 11, and may realize functions such as those shown in FIG. 9. In this manner, the CPU 10 functions as a variety of units, such as the supply unit and the correcting unit, by executing programs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image carrier;

an exposure unit configured to form an electrostatic latent image on the image carrier by irradiating the image carrier with light based on image data;

a developing unit configured to develop the electrostatic latent image formed on the image carrier using a developing material;

a specifying unit configured to specify a specific pixel, of a plurality of pixels that configure the image data, having a second developing material amount used in development performed by the developing unit that is greater than a first developing material amount determined by the image data; and a correcting unit configured to correct an image forming condition so that the second developing material amount for the specific pixel at least approaches the first developing material amount for the specific pixel, wherein the specifying unit is further configured to specify a first number of the specific pixel in a first situation, and specify a second number of the specific pixel in a second situation, the second number being different from the first number, and the second situation being different from the first situation.

2. The image forming apparatus according to claim 1, wherein the correcting unit is further configured to perform a correction by thinning out the specific pixel in a direction perpendicular to a rotational direction of the image carrier as a correction of the image forming condition for correcting the specific pixel.

3. The image forming apparatus according to claim 2, wherein the correcting unit is further configured to perform a correction by dividing the specific pixel into N sub pixels (where N is a natural number of 2 or more) and thinning out at least one of the N sub pixels.

4. The image forming apparatus according to claim 1, wherein the correcting unit is further configured to correct an exposure light amount of the exposure unit as a correction of the image forming condition for correcting the specific pixel.

5. The image forming apparatus according to claim 1, further comprising:

a detection unit configured to detect a physical parameter correlated with an increase in a developing material amount, wherein a first physical parameter is detected in the first situation and a second physical parameter different from the first physical parameter is detected in the second situation.

6. The image forming apparatus according to claim 5, wherein the specifying unit is further configured to find a pixel region configured of pixels, among the plurality of pixels that configure the image data, having pixel values that are greater than or equal to a predetermined value, and specify a predetermined number of pixels from the pixels located at edges of the pixel region as the specific pixels in which the developing material amount will increase due to edge effect.

7. The image forming apparatus according to claim 6, further comprising:

a pixel number determination unit configured to determine the predetermined number of pixels based on the physical parameter detected by the detection unit.

8. The image forming apparatus according to claim 7, further comprising:

a storage unit configured to store the physical parameter and the pixel number in association with each other, wherein the correcting unit is further configured to read out the predetermined number of pixels corresponding to the physical parameter detected by the detection unit from the storage unit or the correcting unit is further configured to compute the predetermined number of pixels by substituting the physical parameter detected by the detection unit in a function.

9. The image forming apparatus according to claim 7, further comprising:

a storage unit configured to store the physical parameter and the pixel value correction amount in association with each other, wherein the correcting unit is further configured to read out the correction amount corresponding to the physical parameter detected by the detection unit from the storage unit or the correcting unit is further configured to compute the pixel value correction amount by substituting the physical parameter detected by the detection unit in a function.

10. The image forming apparatus according to claim 5, wherein the specifying unit is further configured to find a pixel region configured of pixels, among the plurality of pixels that configure the image data, having pixel values that are greater than or equal to a predetermined value, and specify a predetermined number of pixels from the pixels located at an edge of the pixel region on a following end side in a rotational direction of the image carrier as the specific pixels in which the developing material amount will increase due to sweeping.

11. The image forming apparatus according to claim 10, further comprising:

a pixel number determination unit configured to determine the predetermined number of pixels based on the physical parameter detected by the detection unit.

12. The image forming apparatus according to claim 11, further comprising:

a storage unit configured to store the physical parameter and the pixel number in association with each other, wherein the correcting unit is further configured to read out the predetermined number of pixels corresponding to the physical parameter detected by the detection unit from the storage unit or the correcting unit is further configured to compute the predetermined number of pixels by substituting the physical parameter detected by the detection unit in a function.

13. The image forming apparatus according to claim 11, further comprising:

a storage unit configured to store the physical parameter and the pixel value correction amount in association with each other, wherein the correcting unit is further configured to read out the correction amount corresponding to the physical parameter detected by the detection unit from the storage unit or the correcting unit is further configured to compute the pixel value correction amount by substituting the physical parameter detected by the detection unit in a function.

14. The image forming apparatus according to claim 5, wherein the physical parameter correlated with an increase in the developing material amount is at least one of ambient temperature, ambient humidity, a number of images formed, a total operating time of the image forming apparatus, a remaining lifespan of the image carrier, a surface resistance value of the image carrier, and a remaining lifespan of the developing material.

15. The image forming apparatus according to claim 1, further comprising:

a detection unit configured to detect a physical parameter correlated with an increase in a developing material amount, wherein the correcting unit is further configured to correct the image forming condition using a first correction parameter in the first situation and correct the image forming condition using a second correction parameter different from the first correction parameter in the second situation, and wherein the first correction parameter and the second correction parameter are determined according to the physical parameter.

16. The image forming apparatus according to claim 15, wherein the physical parameter correlated with an increase in the developing material amount is at least one of ambient temperature, ambient humidity, a number of images formed, a total operating time of the image forming apparatus, a remaining lifespan of the image carrier, a surface resistance value of the image carrier, and a remaining lifespan of the developing material.

17. The image forming apparatus according to claim 1, wherein the specific pixel of which the image forming condition is corrected using the first correction parameter is the same as the specific pixel of which the image forming condition is corrected using the second correction parameter.

18. The image forming apparatus according to claim 1, wherein at least one of ambient temperature, ambient humidity, a number of images formed, a total operating time of the image forming apparatus, a remaining lifespan of the image carrier, a surface resistance value of the image carrier, and a remaining lifespan of the developing material is different between the first situation and the second situation.

* * * * *